US005215034A

United States Patent [19]

Ronsheim

[11] Patent Number: 5,215,034

[45] Date of Patent: Jun. 1, 1993

[54] TEMPLATE GUIDED SEALANT BEAD DISPENSER

[76] Inventor: Stephen E. Ronsheim, P.O. Box 108, Hwy. 229 E., Napoleon, Ind. 47034

[21] Appl. No.: 802,744

[22] Filed: Dec. 5, 1991

[51] Int. Cl.[5] ..... B05C 5/00

[52] U.S. Cl. ..... 118/323

[58] Field of Search ..... 239/751, 752; 118/323

[56] References Cited

U.S. PATENT DOCUMENTS 4,120,202 10/1978 Range et al. ..... 222/309

*Primary Examiner*—W. Gary Jones
*Assistant Examiner*—Charles K. Friedman
*Attorney, Agent, or Firm*—Woodard, Emhardt, Naughton, Moriarty & McNett

[57] ABSTRACT

A dispenser is mounted on an X-Y coordinate arrangement of sleeves and guide shafts. It is driven by a motor mounted to a carriage assembly and having a magnetic follower unit driven by the motor and associated with a cam on a support made of ferromagnetic material, the cam being contoured as determined by the pattern of the gasket to be formed by the deposited gasket material. The magnetic follower unit is magnetically attached to the cam support and includes a wheel which is rotated by the motor and drives itself around the profile of the cam as the gasket material is deposited onto a work path of the workpiece. In one embodiment the cam is a chain and the drive wheel is a sprocket gear operating on the chain.

11 Claims, 6 Drawing Sheets

TEMPLATE GUIDED SEALANT BEAD DISPENSER

BACKGROUND OF THE INVENTION

1. Field of the Invention

This invention relates generally to dispensers, and more specifically to an apparatus for applying a flowable material to a workpiece.

2. Description of the Prior Art

Fluid containers often are fashioned from multiple parts fastened together, thereby creating joints or interfaces between mating part surfaces, such as flanges, through which fluid can migrate. In some cases the mating parts themselves can be made to effectively seal when fastened together by match-machining the parts to create conforming joint interfaces and by honing the joint interfaces to create very smooth surface finishes. A less expensive and more time efficient sealing method, however, is often desirable for those assemblies which are mass-produced.

One method for sealing production quantity assemblies employs a separate deformable gasket, typically cork, clamped between the mass-produced parts. The gasket provides an effective seal by deforming when clamped to accommodate the varying surface finishes and part-to-part variations. The addition of another part, however, presents a two-fold problem. Although inexpensive as an individual item, a separate gasket increases part count resulting in increased tracking, complexity and other inventory related costs. Furthermore, gasket failure often can be drastic, leading to gross fluid losses through the joint.

Therefore, current production sealing practices typically favor a sealing method representing a compromise between the above-described methods. Rather than using a separate gasket part, a gasket material is applied directly to the mating parts using a separate production process. Gasket materials can be applied in either a liquid or semi-liquid form onto one or both of the mating parts. The applied gasket material can also vary in form and constituency, wherein some materials dry after assembly of the mating parts while others remain semi-plastic or elastomeric. In any case, the gasket material must be deposited on at least one of the part surfaces forming the joint.

One manner of depositing gasket material in a production situation employs a hand-held dispensing gun. In more sophisticated situations a dispensing gun powered to dispense the gasket material is mounted on an articulated arm, typically the arm of a robot. The arm follows a preprogrammed path or dispensing pattern which dictates the movement of the gun relative to the surface or work path to which the gasket material is applied. Such arrangements tend to be comparatively complicated and expensive, thus leading to higher production costs. Often a cam having a pattern or profile is employed to govern the arm and gun movement, wherein the cam replaces the programming and its associated cost and complexity. Current dispensing gun and arm arrangements, however, can be limited in their range of operation due to the articulating nature of the arm. Furthermore, because the gun is often supported cantilevered from the arm, an articulated arm fully extended is susceptible to higher deflections and, therefore, potentially reduced accuracy.

A need therefore exists for an improved gasket material dispenser. Such a dispenser should have a large range of operation. Also desired is a dispenser having increased accuracy, wherein the dispenser is less prone to deflection. The dispenser should be economical both in initial cost and in recurring costs.

SUMMARY OF THE INVENTION

Described briefly, according to a typical embodiment of the present invention, is an apparatus for applying a flowable material to a workpiece along a work path including a frame for locating the workpiece; a first carriage slidably mounted on the frame, the first carriage guided by the frame to translate in a first direction; a second carriage slidably mounted on the first carriage, the second carriage guided by the first carriage to translate in a second direction relative to the first carriage, wherein the second carriage has a dispenser and a cam follower mounted thereto; and a cam mounted to the frame, the cam having a profile patterned after the work path. The cam follower includes means for following the profile of the cam, and the dispenser includes means for dispensing the material. The cam follower follows the profile of the cam causing the first carriage to translate in the first direction and the second carriage to translate along the first carriage to translate a portion of the dispenser according to the cam profile to apply the material along the work path.

One object of the present invention is to provide an improved gasket material dispenser.

Another object of the present invention is to provide a gasket material dispenser having a large range of operation.

Another object of the present invention is to provide a gasket material dispenser having increased accuracy, wherein the dispenser is less prone to deflection.

Still another object of the present invention is to provide a gasket material dispenser economical both in initial cost and in recurring costs.

Related objects and advantages of the present invention will become apparent from the following description.

BRIEF DESCRIPTION OF THE DRAWINGS

In the various figures of drawing, where portions are broken away and partial sections are used in some views to show interior details.

DESCRIPTION OF THE PREFERRED EMBODIMENTS

Figure 1:
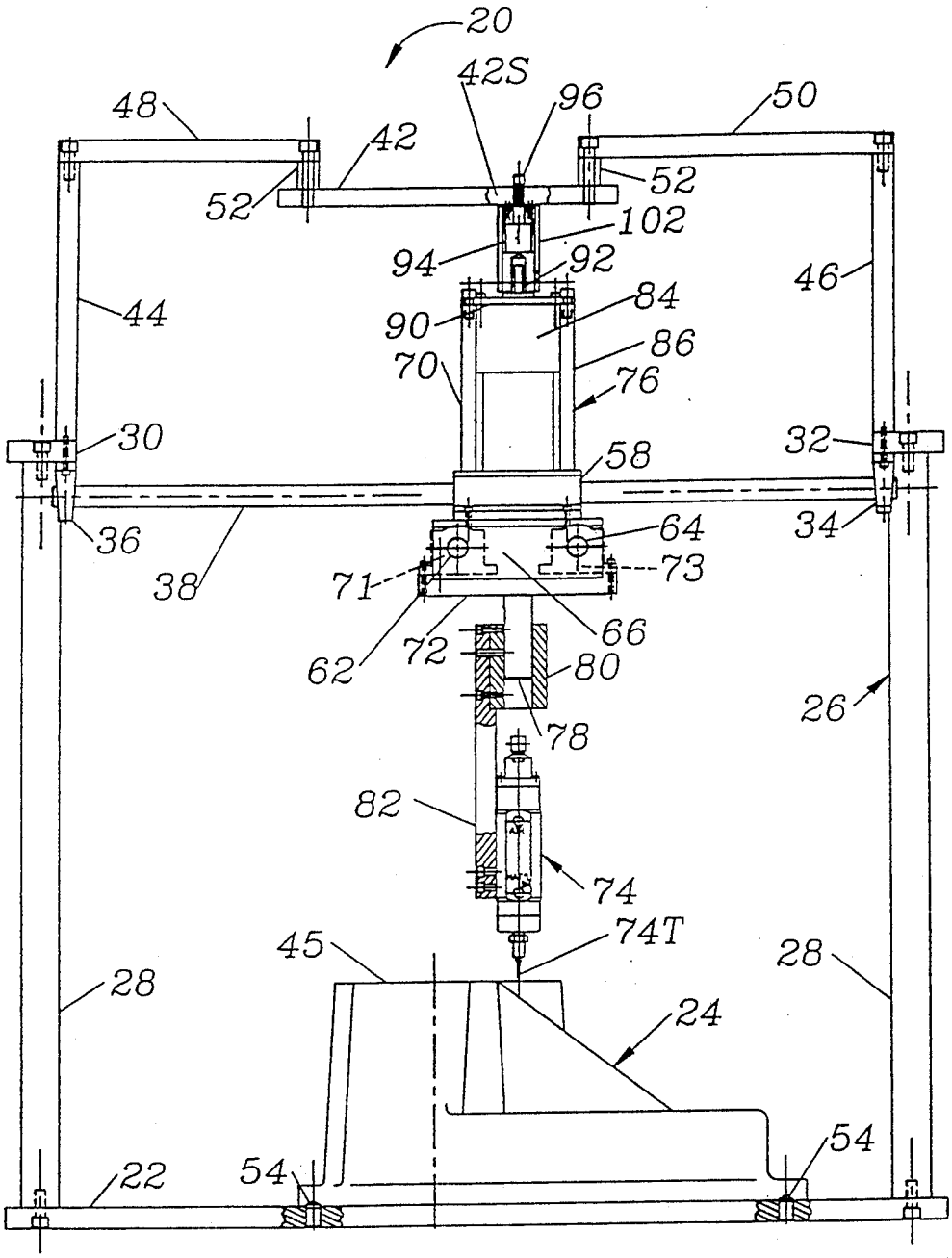
FIG. 1 is a front elevational view of a dispensing machine according to one embodiment of the present invention having a workpiece received therein.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
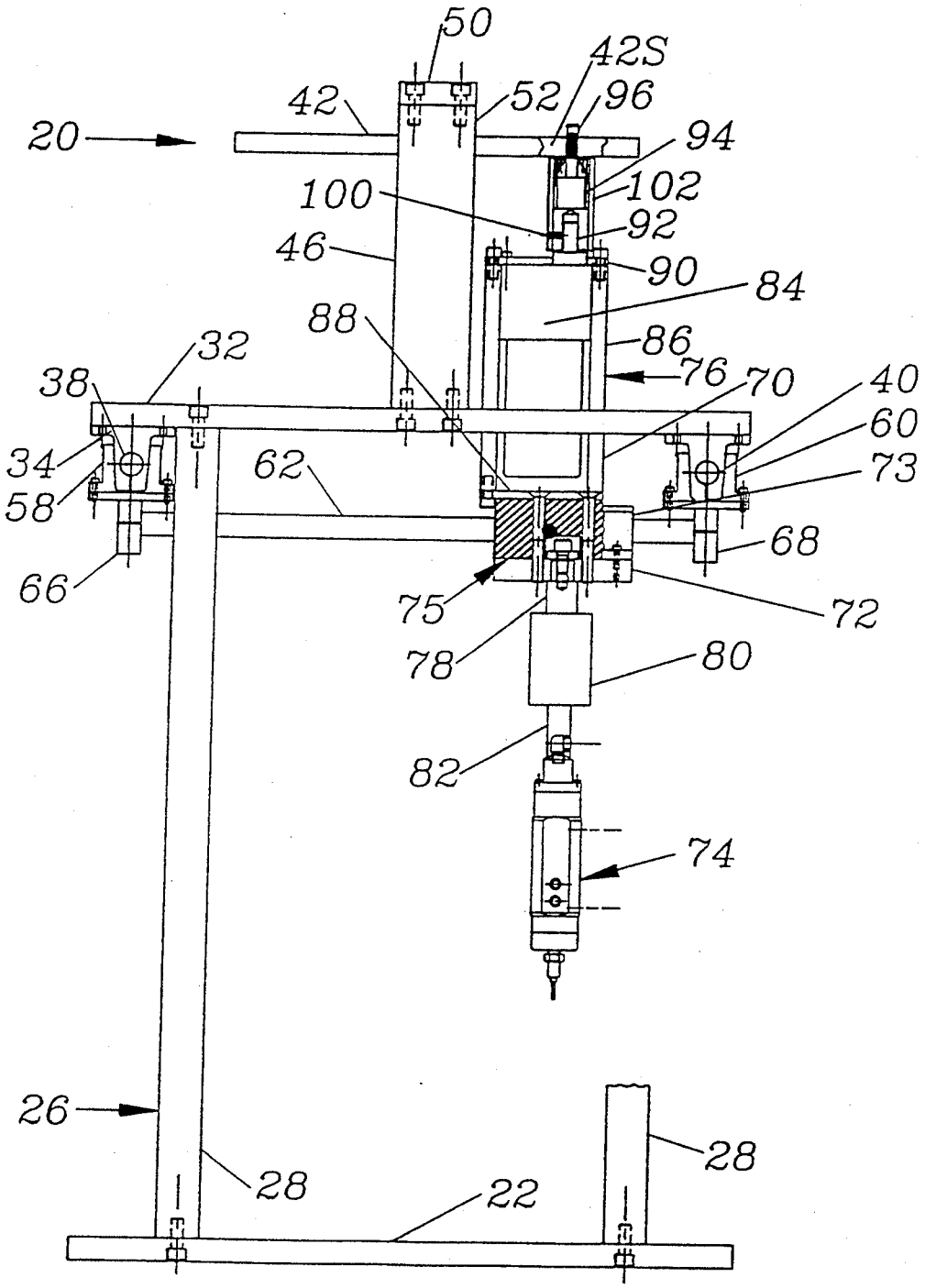
FIG. 2 is a right side elevational view depicting the dispensing machine of FIG. 1.
Figure 3:
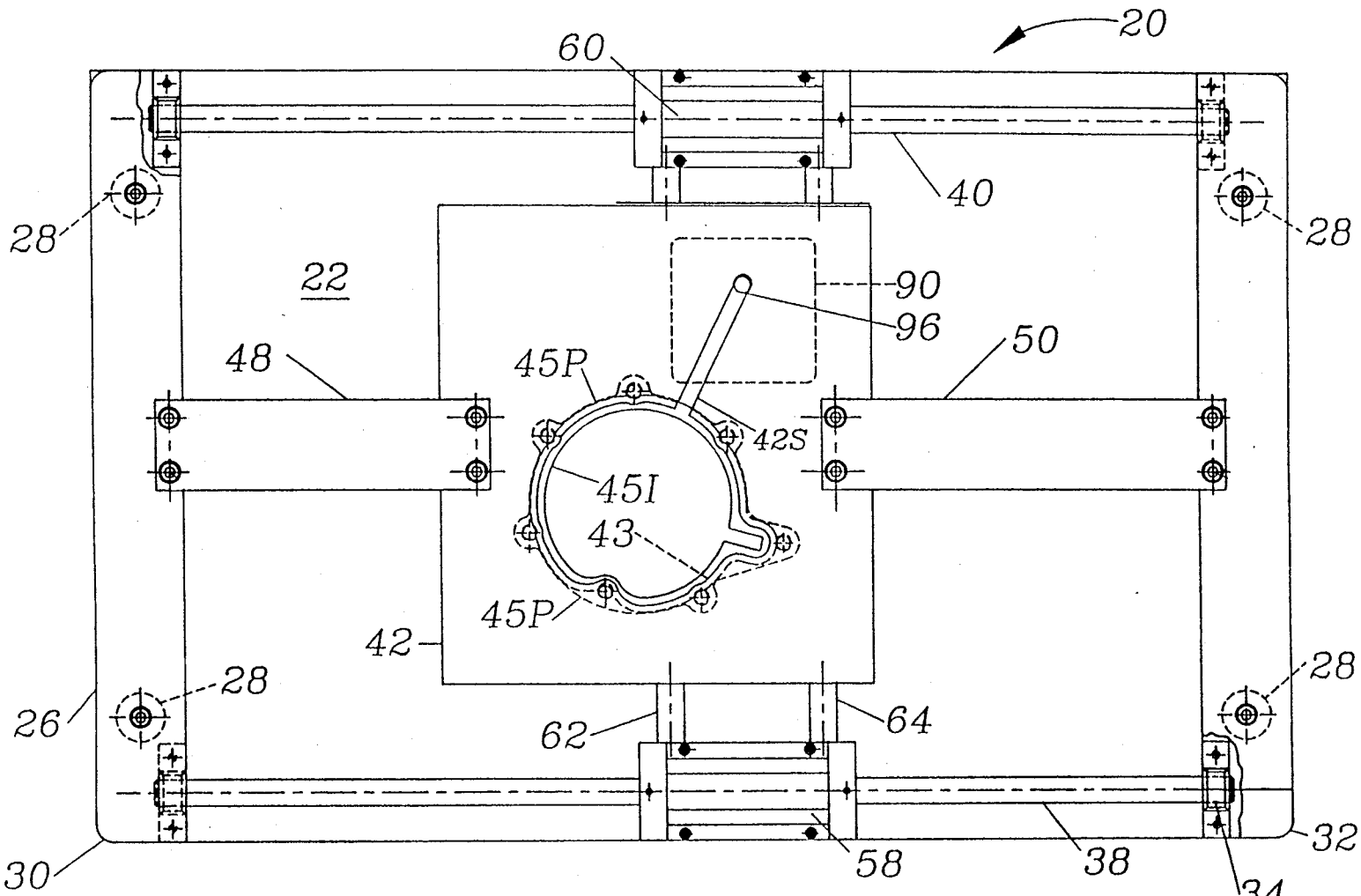
FIG. 3 is a top plan view depicting the dispensing machine of FIG. 1.

Referring now to FIGS. 1-3, a dispensing machine 20 is shown including a base plate 22 having a workpiece 24 located thereon. Base plate 22 is a component of base frame 26. Frame 26 also includes four support posts 28 disposed at each of four corners of machine 20, with left horizontal support 30 and right horizontal support 32 attached thereon. Right shaft support block 34 is fastened to the bottom of right horizontal support 32 at the front of the frame. Similarly, left shaft support block 36 is fastened suspended from left horizontal support 30. Identical support blocks are provided at the rear of supports 30 and 32. Support blocks 34 and 36 provide mounting points for guide shaft 38 at the front, and the other two support blocks mount the guide shaft 40 at the rear. Guide shafts 38 and 40 being fixed to their support blocks and somewhat straddle mounted form a squarish rigid base frame 26 to which the remaining machine components can be mounted.

Elevated from left and right horizontal supports 30 and 32 of frame 26 is cam or template 42. Cam 42 has a central aperture with a vertical wall cam profile 43 correlating to a work path to be followed in depositing gasket material on the top face 45 of the workpiece 24. Cam 42 can include both internal and external profiles depending on the workpiece size and the work path shape. Vertical supports 44 and 46 attach to left and right horizontal supports 30 and 32, respectively, at approximately the support mid-points, thereby centrally locating cam 42 above frame 26. Attaching cam 42 to vertical supports 44 and 46 are left cam holder 48 and right cam holder 50. Cam 42 is suspended from cam holders 48 and 50 via cam spacers 52.

Frame 26 is contemplated having a variety of forms, all of which rigidly locate and mount guide shafts 38 and 40 and cam 42 relative to workpiece 24 to preclude deflection, thus assuring machine accuracy. Also contemplated is a frame bolted in place to an existing floor or other horizontal support structure, wherein workpiece 24 is received on the floor and the floor performs essentially the same function as base plate 22.

Work piece 24 is received on base plate 22 by locating pins 54. A number of locating pins can be provided to fixedly dispose workpiece 24 relative to frame 26, including pins received in corresponding locating holes in the workpiece and pins which encompass the workpiece to locate the workpiece along its periphery. In the one embodiment, machine 20 includes two cylindrical locating pins 54 received by locating holes in workpiece 24.

Twin pillow blocks 58 and 60 at the front and rear, respectively, of the machine, are slidably mounted on guide shafts 38 and 40. Shaft support blocks 66 and 68 are fastened to the underneath side of pillow blocks 58 and 60, respectively. Guide shafts 62 and 64, similar to guide shafts 38 and 40, are fastened to support blocks 66 and 68. Thus a first carriage is provided comprising the elements 58, 60, 62, 64, 66, and 68. Pillow blocks 58 and 60 provide close fitting sleeves receiving guide shafts 38 and 40 therethrough, respectively, to translate this first carriage along a first path defined by guide shafts 38 and 40. Thus, the first carriage is limited in its travel so that it can only traverse machine 20 via guide shafts 38 and 40. Pillow blocks 58 and 60 are one example of a linear motion device. Other linear motion devices are also contemplated. For example, other linear motion devices might include support blocks and rails, other slide assemblies, roller bearing pillow blocks and ball bushings.

Shaft support blocks 66 and 68 suspend guide shafts 62 and 64 below guide shafts 38 and 40. Guide shafts 38 and 40 therefore define a plane above and parallel to a plane defined by guide shafts 62 and 64. A second carriage 70 is slidably mounted to the first carriage via guide shafts 62 and 64. Similar to the sliding interface between guide shafts 38 and 40 and pillow blocks 58 and 60, second carriage 70 incorporates a center base 72 having parallel pillow blocks 71 and 73 mounted thereto and which provide close fitting sleeves receiving guide shafts 62 and 64 therethrough, respectively, to translate second carriage 70 along a second path defined by guide shafts 62 and 64. Thus, carriage 70 is limited in its travel so that it can only traverse the first carriage via guide shafts 62 and 64.

Therefore, the motion of carriage 70 can be described as an "X-Y" motion, wherein an "X" direction is defined by the first carriage traveling along guide shafts 38 and 40 and a "Y" direction is defined by second carriage 70 traveling along guide shafts 62 and 64. By employing an X-Y motion scheme, carriage 70 effectively encompasses a large range of operation limited only by the peripheral boundaries of machine 20 as dictated by the lengths of the respective guide shafts.

A dispenser assembly 74 and a cam follower assembly 76 are attached to second carriage 70. The dispenser assembly is oriented with its longitudinal axis normal to the X-Y plane of motion. Dispenser assembly 74 is suspended from center base 72 via connector bar 78, mounting block 80 and extension arm 82 to which the dispenser assembly is attached. Dispenser assembly 74 is typical of those used in industry, an example of which is a dispenser commercially available from Three Bond Company, Ltd. having a main office in Japan. Information from ThreeBond can be requested from its subsidiary company, Three Bond of America, Inc., 20815 Higgins Court, Torrence, Calif. 90501, U.S.A. Dispenser assembly 74 includes from Three Bond Company SVR dispensing valve Part No. 64T044, needle block NB4-PT Part No. 64T052 and needle MN G-13 Part No. 64I102.

Dispenser assembly 74 also includes means for receiving and supplying the gasket material common in the industry, wherein different types of gasket materials can be supplied. For example, silicone gasket materials are contemplated including materials having deoximization as a reaction mechanism and those having deacetonization as a reaction mechanism. Similarly, anaerobic gasket materials are contemplated having radicalpolymerization as a reaction mechanism. Aqueous gasket materials are also envisioned having evaporation or drying as a reaction mechanism.

Spacer 75 (shown in section in FIG. 2) is fastened to center base 72 between pillow block 73 (partially cut away in FIG. 2 to show the spacer) and pillow block 71 (hidden from view in FIG. 2 by spacer 75 and pillow block 73) by screws into base 72. A lower motor-mount plate 88 is fastened on top of spacer 75. Four spacer tube and tie units 86 are fastened to and extend up from lower motor mount plate 88 to upper motor mount plate 90.

Figure 5:
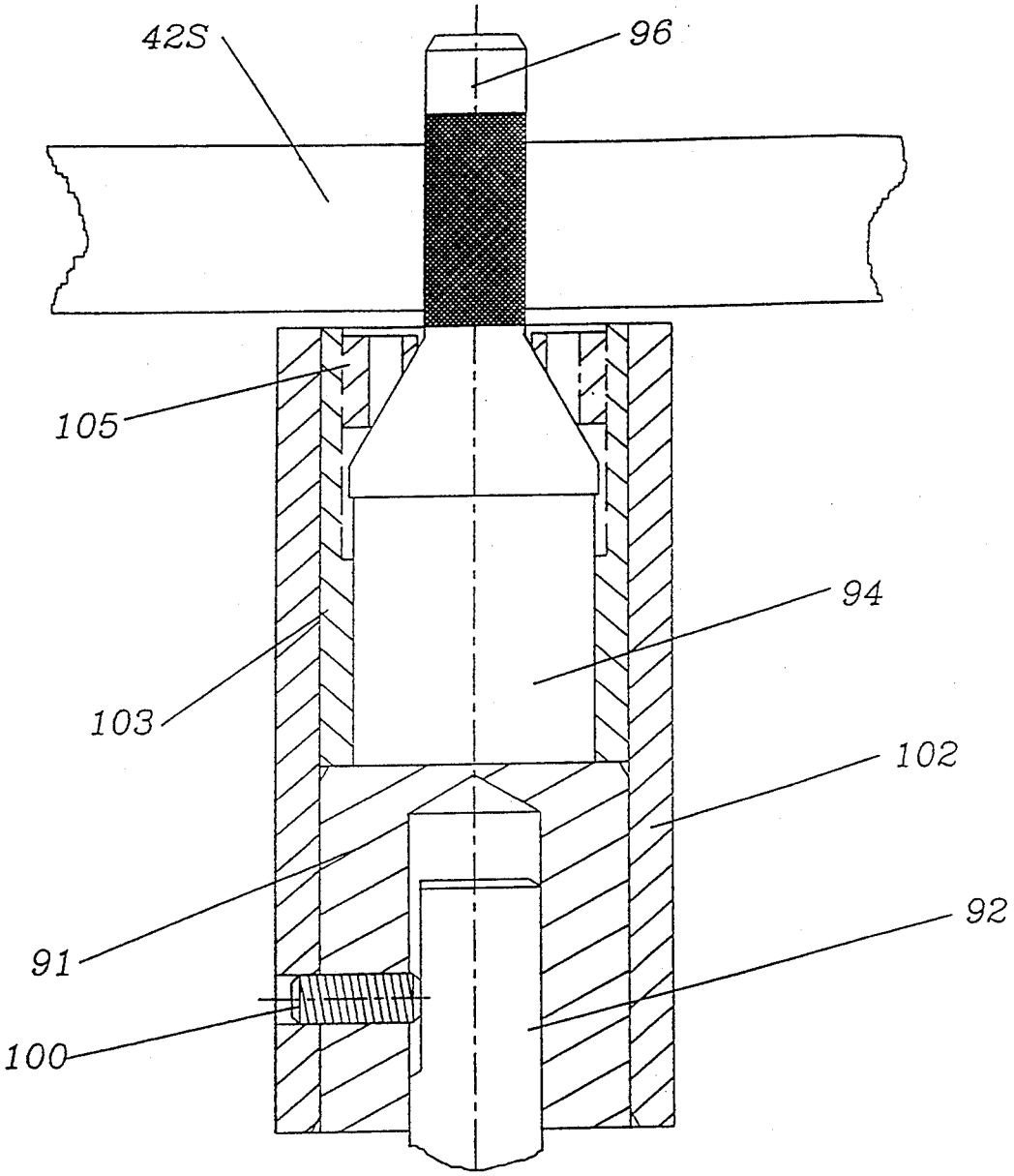
FIG. 5 is an enlarged elevational view of the cam follower stylus and magnet assembly.

Cam follower assembly 76 is oriented with its longitudinal axis normal to the X-Y plane of motion. Cam follower assembly 76 includes a variable speed DC drive motor 84 with the upper end of the motor being fastened to upper motor mount 90 and suspended therefrom above center base 72. A steel magnet-base 91 is fittingly received on the upwardly extending output shaft 92 of motor 84 and secured there by a set screw 100, FIG. 5. A steel sleeve 102 is press fitted onto the magnet base 91. A non-ferrous (brass or aluminum, for example) sleeve 103 is press fitted into the sleeve 102. A purchased magnet 94 is slip fitted into the sleeve 103. A cam follower "stylus" roller 96 having a knurled exterior cylindrical surface for engagement with the cam profile edge 43 (FIG. 3) of cam 42 is slip-fitted into the cylindrical sleeve 103. The magnet 94 and stylus 96 are held in place in the sleeve 102 by a brass nut 105 which is screwed into the top of the sleeve 103 and has a conical central aperture in it engaging the conical base of the stylus 96. There are at least two vertical holes in the nut to receive a spanner wrench to install and remove the nut. The combination sleeve 102 and magnet base 91 are indexed to output shaft 92 by the set screw 100. The motor 84 drives the follower assembly at a constant velocity determined by the selected motor speed and the stylus diameter.

A magnetic flux path is established from the bottom of the magnet 94 through the base 91 and out and up through the steel sleeve 102 cam plate 42 and into the drive roller stylus 96 and down through the stylus into the top of magnet 94. The upper end of the sleeve 102 is closely spaced from the bottom of the cam plate 42 so as to permit the establishment of the magnetic flux path from the sleeve through the plate to the follower roller 96, without causing a short. Thus, the flux establishes the magnetic attraction of the roller stylus 96 to the cam to keep the roller in contact with the cam edge as the motor drives the dispenser along one edge of the slot 42S from the rest position shown in the figures to the cam contour edge 43 followed during the dispensing of the gasket material and then return along the other edge of the slot 42S to the rest position.

Stylus 96 can be of various diameters, depending on application. Greater diameters yield higher magnetic forces to promote stronger engagement of drive stylus 96 to cam 42. A trade-off, however, exists between the magnetic force required for engagement, and the torque and speed of the motor. It appears that an optimum force is provided in an embodiment where the assembly of parts 91, 94, 96, 102, 103 and 105, when manually separated from the machine and held with its axis horizontal, and with end of sleeve 102 abutting and magnetically attached to the face of a ten pound vertically oriented steel plate, can lift the plate.

Means other than magnetic for engaging and following a template profile are contemplated. For example, drive roller 96 can be physically held against cam 42 with a gear system. Gear systems wherein positive interlocking engagement is provided, or a type of adhesive arrangement, or a hook and loop (e.g., Velcro) arrangement might be employed.

Dispensing machine 20 operates by drive roller 96 engaging profile 43 of cam 42. Profile 43 is a peripheral surface comprising a vertical side wall of cam 42 for the roller 96 to engage. Typically the wall is as high as the cam is thick, but it can be less than full height if desired. Motor 84 is energized to rotate output drive 92 and drive roller 96. Roller 96 advances around cam 42 by rolling along profile 43. The magnetic attraction between drive roller 96 (acquired from magnet 94) and cam 42, provides the normal (i.e. directed radially from the roller center to the point of contact on the cam profile) force necessary to facilitate the rolling action. Because the rolling action requires a combination of normal force and coefficient of friction, the knurled surface of the first embodiment provides the necessary friction required for machine 20 to effectively function in oil-mist atmospheres. Because drive roller 96 is magnetized to engage cam 42, the cam is constructed employing a ferromagnetic material, the material at a minimum comprising the profile portion of cam 42.

As the cam follower assembly advances along profile 43, dispenser assembly 74 is advanced in a similar pattern. Second carriage 70 translates along guide shafts 62 and 64 of the first carriage, and the first carriage translates along guide shafts 38 and 40. The motion of the cam follower assembly around the cam is broken down into component motions in the X and Y directions defined by the guide shafts, as previously discussed. By employing carriages moving in an X-Y fashion to transfer motion of the cam follower assembly to the dispenser assembly, a rectilinear range of operation is provided. With guide shafts 38 and 40 substantially perpendicular to guide shafts 62 and 64 and cam follower assembly 76 and dispenser assembly 74 depositing material in a direction perpendicular to the plane defined by the guide shafts, the range of motion is rectangular and is defined by the lengths of guide shafts 62 and 64 and the lengths of guide shafts 38 and 40.

Guide shaft 38 is parallel to guide shaft 40, and guide shaft 62 is parallel to guide shaft 64. Guide shafts 38 and 40 are oriented perpendicular to guide shafts 62 and 64, thereby creating the X-Y motion. Cam follower assembly 76 and dispenser assembly 74 are oriented perpendicular to the X-Y plane of motion, wherein each has a longitudinal axis perpendicular to the X-Y plane. In the embodiment illustrated in FIG. 3, the workpiece top surface 45 to which the gasket material is to be applied is partially hidden by the cam plate 42. The outboard edge of this surface is shown in dotted lines 45P, being hidden by the part of cam plate 42 outboard of the cam profile edge 43. The inboard edge of the surface 45 is shown at 45I. The slot 42S at the beginning and end of the cam profile provides for entry of the second carriage (and thereby the dispenser) to, and departure from the area immediately above the workpiece to the home location shown in the figures, to facilitate installation and removal of the workpiece. The roller 96 has a diameter of ⅜ inch, while the width of the slot 42S is 7/16 inch, so the roller 96 will follow one edge of the slot as it proceeds from the home position to the profile 43, and will follow the other edge of the slot as it leaves the profile to return home. In the illustrated embodiment, the stylus 96 and dispenser tip 74T have colinear axes. Therefore, profile 43 is offset from the exact work path to be followed immediately above the surface 45 by the dispenser tip 74T. The amount of the offset is one-half the diameter of the roller 96. Thus, where the roller diameter is ⅜ inch, the offset is 3/16th inch. It should be understood that while the illustrated embodiment uses an internal template, the invention can be applied using an external template. Also contemplated is a profile shaped similar to a projected work path, wherein profile 43 is reduced or enlarged in scale relative to workpiece 24 and wherein cam follower assembly 76 is not coaxial with dispenser assembly 74, instead having an axis displaced at a distance from the axis of deposit of material from dispenser assembly 74.

In this example, the majority of the frame components of dispensing machine 20 are fashioned from cold rolled steel as commonly provided for in the industry. Cold rolled steel is a ferromagnetic material and, therefore, can also be used in the manufacture of the cam. Other materials are contemplated having the necessary properties to provide a rigid machine structure. Cam 42 is CNC machined so that a precise profile is generated and the gasket material is accurately dispensed onto workpiece 24. Base plate 22 is a 1% carbon steel heat treated to a Rockwell C hardness ranging between 58 and 60. Hardened and ground guide shafts 38, 40, 62 and 64 are products of Thompson Industries, Inc. of Port Washington, N.Y. 11050. Shafts 38 and 40 are ¾ inch diameter by 30¼ inches long. Shafts 62 and 64 are ¾ inch diameter and 19½ inches long. The shafting is case hardened to provide a durable working surface. The lengths of the guide shafts define a work area slightly less than the lengths of the guide shafts or slightly smaller than 19½ inches wide by 30¼ inches long.

Table 1 provides a list of parts for dispensing machine 20 available from the Christopher Stephen Corporation, P.0. Box 108-Highway 229 East, Napoleon, Ind. 47034.

TABLE 1

| PART NAME | PART NO. |
|---|---|
| Shaft Support Block 34 | 10394 |
| Shaft Support Block 36 | 10399 |
| Twin Pillow Block 58 | 10398 |
| Twin Pillow Block 60 | 10398 |
| Pillow Block Carrier 61 | 10397 |
| Shaft Support Block 68 | 10394 |
| Center base 72 | 10386 |
| Spacer 73 | 10387 |
| Connector Bar 78 | 10392 |
| Mounting Block 80 | 10390 |
| Extension Arm 82 | 10391 |
| DC Motor 84 | 10396 |
| Tie Rod 86 | 10393 |
| Lower Motor Mount 88 | 10388 |
| Magnet Assembly 94 | 10385 |

Other ranges of operation can be created and are contemplated by disposing guide shafts 62 and 64 at an angle other than perpendicular to guide shafts 38 and 40, the resulting range of motion being that of a parallelogram. Similarly, guide shafts 38 and 40 need not be in a plane parallel to the plane defined by guide shafts 62 and 64, as skewed planes can create another distinct range of motion. By breaking down the motion of cam follower assembly 76 as it follows profile 43 of cam 42 into separate motion components, a variety of workpiece shapes can be accommodated according to various embodiments of this invention.

Figure 4:
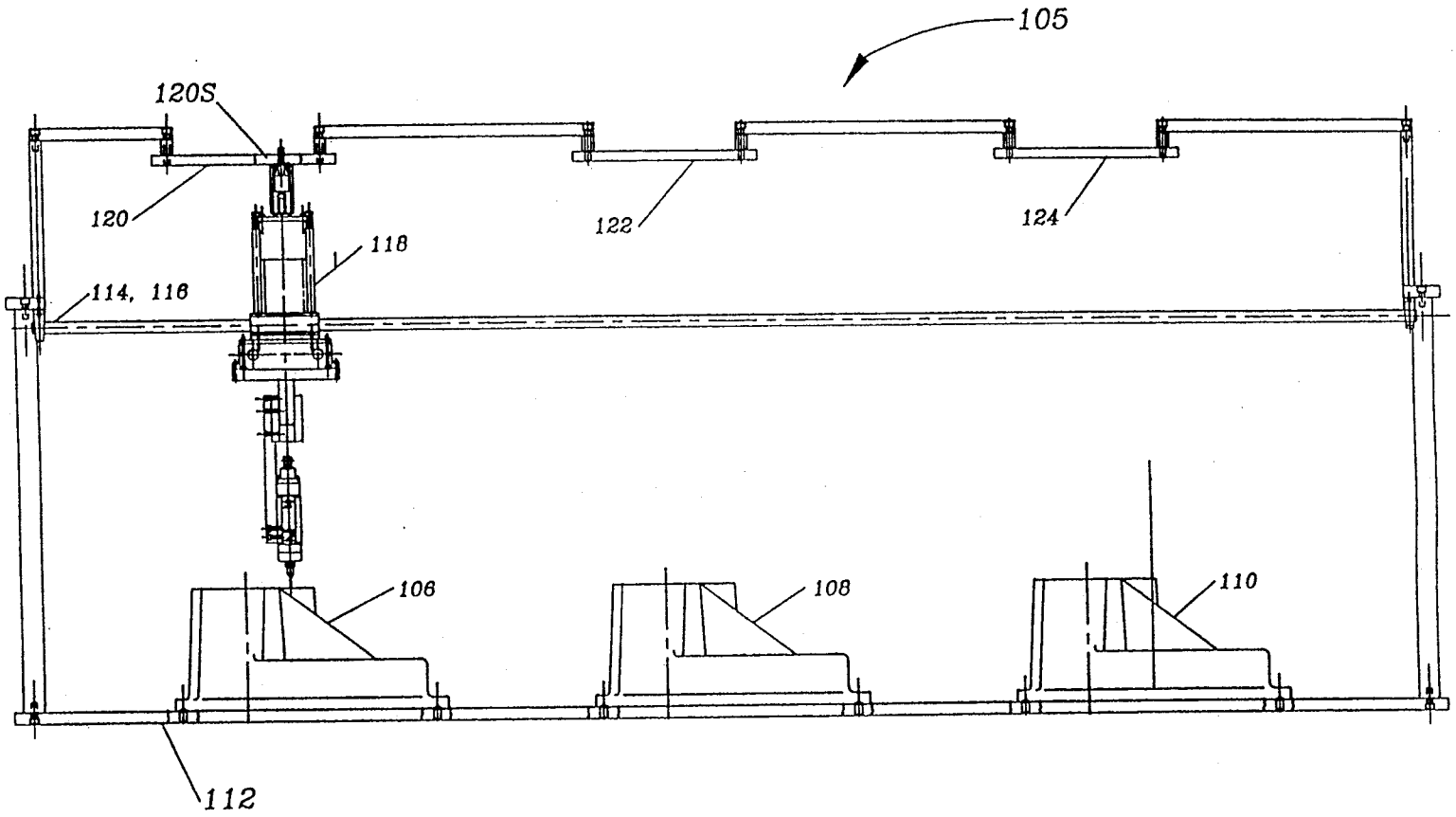
FIG. 4 is a front elevational view of a dispensing machine according to a second embodiment of the present invention having multiple cams and workpieces.

Also contemplated is a dispensing machine 105 as depicted in FIG. 4, wherein three workpieces, 106, 108 and 110 respectively, are mounted on base plate 112. Guide shafts 114 and 116 provide sufficient travel in the direction of the multiple workpieces for carriage 118 to translate. Similarly cams 120, 122 and 124 are provided correlating to each workpiece. In this embodiment, if a single dispenser is used, it may be manually translated from one workpiece to the next or, if automatic advance is to be used, tracks from one cam profile to the next may be used.

Figure 6:
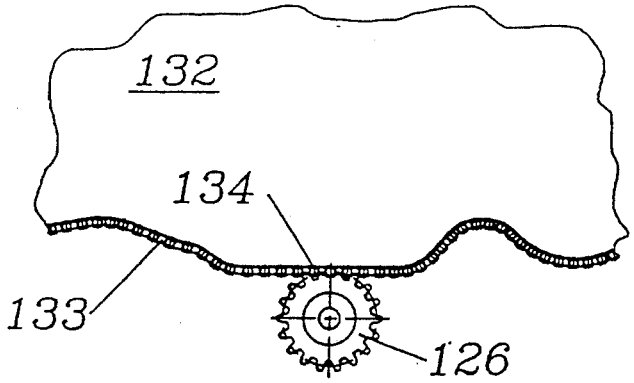
FIG. 6 is a fragmentary top plan view of the cam and follower assembly according to a third embodiment of the present invention.
Figure 7:
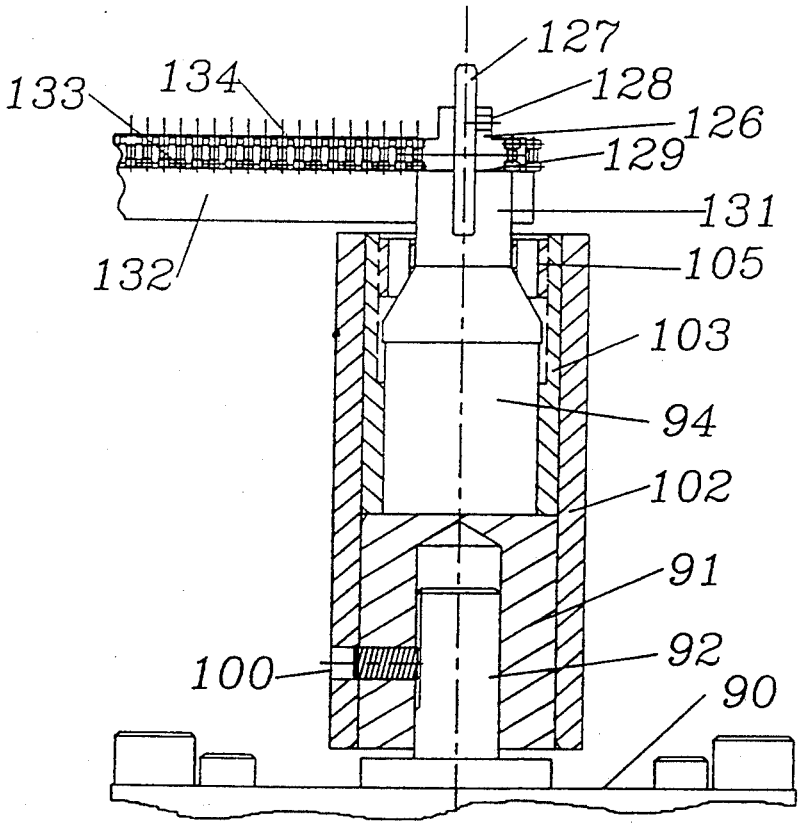
FIG. 7 is a fragmentary elevational view of the cam and follower according to the third embodiment.

It was mentioned above that a gear system for driving the stylus along the cam profile might be used. An example is shown in FIGS. 6 and 7 where it should be understood that the components shown would be substituted for similar components shown in FIGS. 1-5. For example, the magnet 94, motor drive shaft 92, magnet base 91, sleeve 102, sleeve 103, and nut 105 can be the same. But instead of having a knurled surface on the stylus 96 of FIG. 5, this embodiment has a sprocket 126 received on a stem 127 and secured thereto by a set screw 128. This sprocket may rest on a shoulder 129 on top of the stylus base 131 which is secured to the top of the magnet 94 by the nut 105. Stem 127 is integral with the stylus base 131, or may be a pin that is pressed into the stylus base 131 as shown in FIG. 7. The stylus base 131 is made of a ferromagnetic material. The sprocket 126 material may be anything suitable. Stainless steel, brass or nylon are examples.

In this embodiment, instead of the cam plate 132 having a smooth contour to be followed as in the previous embodiment, this cam plate has a ledge 133 on it and supporting a chain 134 which is arranged on the plate according to the contour to be followed. In other words, the chain 134 is laid out according a cam pattern mimicking the irregular profile 43 in the previously described embodiments. But in this case, instead of having a knurled roller stylus running on a smooth surface, the cam follower sprocket "stylus" 126 follows the chain pattern cam profile. The chain is offset to either side of a vertical upward projection of the desired dispenser tip path by an amount tailored to the sprocket drive radius and the chain configuration. Where the cam chain serves as an internal template, normally the offset will be to the outside of the vertical upward projection of the desired path. The stylus base 131 is magnetized by the magnet 94 in the same manner as the stylus was magnetized in the previously described embodiment, with the magnetic circuit being from the magnet 94 through the stylus base 131, the cam plate 132 down across the gap into the sleeve 102 and back through the magnet base 91 into the magnet 94, in the same manner as the magnetic path of the previously described embodiments. The sprocket 126 is not magnetized but the flux path is much the same as on the knurled stylus magnet assembly. The chain is non-ferrous, being made from polyurethane links on steel cable. As an example, the chain 134 can be Flex-E-Gear brand cable drive chain 32 GCF series. Sprocket gear 126 can be Flex-E-Gear No. GG33S14-18. These are available from W.M. Berg, Inc. of East Rockaway, N.Y.

With any of the embodiments, the dispensing operation can be controlled manually by starting the cam follower assembly and the dispenser assembly manually after the workpiece has been put in place. Alternatively, control means for controlling the operation of the dispensing machine can be provided, wherein the operation of both the cam follower motor and the dispenser assembly can be initiated automatically via a remote control station after the workpiece has been placed.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed:

1. An apparatus for applying a flowable material to a workpiece along a work path, comprising:

a frame;

a first carriage slidably mounted on the frame, the first carriage guided by the frame in a first rectilinear direction;

a second carriage slidably mounted on the first carriage, the second carriage guided by the first carriage in a second rectilinear direction relative to the first carriage, the second carriage having a dispenser and a cam follower mounted thereto;

a cam mounted to the frame, the cam having a profile patterned after the work path;

the cam follower including means for following the profile of the cam, and the dispenser including means for dispensing the material;

wherein the cam follower follows the profile of the cam causing the first carriage to translate in the first direction and the second carriage to translate in the second direction relative to the first carriage to translate a portion of the dispenser according to the cam profile to apply the material along the work path.

2. The apparatus of claim 1 wherein the second direction is perpendicular to the first direction to define an X-Y plane in the first and second directions and the second carriage translates in the X-Y plane.

3. The apparatus of claim 2 wherein the cam follower and the dispenser are aligned on axes perpendicular to the X-Y plane.

4. The apparatus of claim 2 wherein the cam follower includes a motor driving a drive wheel as means for following the profile of the cam and the drive wheel is rotated by the drive motor to drive itself along the profile of the cam.

5. The apparatus of claim 4 wherein the cam includes a ferromagnetic material and the drive wheel is magnetized and is part of a magnetic circuit path as means for engaging the drive wheel with the cam and thereby following the profile of the cam, whereby the magnetized drive wheel maintains contact of the drive wheel with the cam as the drive wheel is rotated by the drive motor to drive itself along the profile of the cam.

6. The apparatus of claim 5 wherein;

the frame includes a first pair of horizontally-spaced circular guide shafts mounted thereto to guide the first carriage, and the first carriage includes a first pair of sleeves for receiving the first pair of guide shafts therethrough; and the first carriage includes a second pair of horizontally-spaced circular guide shafts mounted thereon transverse to the first pair of circular guide shafts to guide the second carriage, and the second carriage includes a second pair of sleeves receiving the second pair of guide shafts therethrough.

7. The apparatus of claim 6 wherein the wheel is a roller having a knurled exterior cylindrical surface thereon for engaging the profile of the cam.

8. The apparatus of claim 7 wherein the motor is a variable speed, constant velocity drive motor.

9. The apparatus of claim 4 wherein the drive wheel has a series of circularly spaced teeth thereon and the cam has a series of abutment surfaces engageable by the teeth of the wheel as the motor drives the wheel along the cam profile.

10. The apparatus of claim 9 wherein the drive wheel is a sprocket and the cam is a chain engaged by the sprocket.

11. The apparatus of claim 10 and further comprising:

a chain support made of ferromagnetic material; and a sprocket support which is magnetized and makes a magnetic circuit with the chain support to assist in keeping the sprocket engaged with the chain as the motor moves the sprocket along the chain.

* * * * *